US011084086B1

(12) United States Patent
Whaley

(10) Patent No.: US 11,084,086 B1
(45) Date of Patent: Aug. 10, 2021

(54) HAMMER PUNCH TOOL

(71) Applicant: EURO TOOL, INC., Grandview, MO (US)

(72) Inventor: Jay Nicholas Whaley, San Diego, CA (US)

(73) Assignee: EURO TOOL, INC., Grandview, MO (US)

( * ) Notice: Subject to any disclaimer, the term of this patent is extended or adjusted under 35 U.S.C. 154(b) by 365 days.

(21) Appl. No.: 15/881,014

(22) Filed: Jan. 26, 2018

(51) Int. Cl.

| | |
|---|---|
| ***B21J 7/02*** | (2006.01) |
| ***B21D 53/44*** | (2006.01) |
| ***B21D 31/06*** | (2006.01) |
| ***B25D 1/16*** | (2006.01) |

(52) U.S. Cl.
CPC ..... *B21J 7/02* (2013.01); *B21D 31/06* (2013.01); *B21D 53/44* (2013.01); *B25D 1/16* (2013.01)

(58) Field of Classification Search
CPC ..... B25C 1/02; B21J 7/02
USPC ..... 72/352
See application file for complete search history.

(56) References Cited

U.S. PATENT DOCUMENTS

| | | | | |
|---|---|---|---|---|
| 4,403,725 | A * | 9/1983 | Lawrence | B25C 1/02 227/147 |
| 4,676,424 | A | 6/1987 | Meador et al. | |
| 4,703,549 | A * | 11/1987 | Grandt | B25B 27/02 173/91 |
| 7,509,721 | B1 * | 3/2009 | Liang | A41H 37/005 29/243.5 |
| 9,278,386 | B1 | 3/2016 | Bellino et al. | |

FOREIGN PATENT DOCUMENTS

| | | |
|---|---|---|
| CN | 201262599 Y | 6/2009 |
| CN | 103718827 A | 4/2014 |
| CN | 205270556 U | 6/2016 |

* cited by examiner

*Primary Examiner* — Adam J Eiseman
*Assistant Examiner* — Mohammed S. Alawadi
(74) *Attorney, Agent, or Firm* — Stinson LLP

(57) ABSTRACT

A hammer punch tool having a guide and a punch that is slidably coupled to the guide. The guide has a force transfer surface and a cavity accessible through an opening in the guide. The punch has a portion that is slidably received within the cavity of the guide through the opening in the guide. The guide slides relative to the punch between a reset position of the guide (or extended position of the punch), in which a portion of the punch engages the guide to retain at least a portion of the punch within the cavity, and a hammer position of the guide (or retracted position of the punch), in which the force transfer surface of the guide engages the punch. A method of forming material with the hammer punch tool by striking the punch with the guide.

17 Claims, 6 Drawing Sheets

HAMMER PUNCH TOOL

CROSS-REFERENCE TO RELATED APPLICATIONS

Not applicable.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The present application relates generally to a tool for forming or shaping material and, in particular, to a hammer punch tool preferably designed to shape and form jewelry.

2. Description of Related Art

Jewelry may be formed or shaped with a hammer and a separate punch or series of punches each having a different tip that can shape or form the jewelry in a desired manner. For example, if it is desired to bezel mount a stone for jewelry, a jeweler may select a punch suitable for the task, place the tip of the punch on the jewelry adjacent the stone, and strike the opposite end of the punch with the hammer to shape the jewelry around the stone. The punch must be moved around the stone as the jeweler strikes it with the hammer to securely mount the stone. While the jeweler moves the punch into the desired location and strikes it with the hammer, the jeweler must focus on striking the punch at the desired location, in a desired direction, and with a desired amount of force in order to properly shape the jewelry. The jeweler must also focus on the effect of the punch strikes on the jewelry to ensure the jewelry is being shaped in the manner desired. While many jewelers have become proficient in shaping jewelry in this manner, the process is relatively difficult to control due to potential variance in the force and direction of force with which the hammer strikes the punch.

BRIEF SUMMARY OF THE INVENTION

A hammer punch tool in accordance with one embodiment of the invention described herein includes a guide and a punch that is slidably coupled to the guide. The guide has a force transfer surface and a cavity accessible through an opening in the guide. The punch has a portion that is slidably received within the cavity of the guide through the opening in the guide. The guide slides relative to the punch between a reset position of the guide (or extended position of the punch), in which a portion of the punch engages the guide to retain at least a portion of the punch within the cavity, and a hammer position of the guide (or retracted position of the punch), in which the force transfer surface of the guide engages the punch. With an end of the punch positioned on material to be formed, such as jewelry, a user can slide the guide relative to the punch from the reset position to the hammer position striking an end of the punch with the force transfer surface of the guide to transfer force and energy from the guide to the punch and from the punch to the material being formed.

The punch preferably has a first end positioned outside of the cavity of the guide and a second end positioned within the cavity of the guide. The punch also preferably includes a stop positioned adjacent the second end within the cavity. The stop preferably engages a portion of the guide to retain the second end of the punch within the cavity when the guide is in the reset position. The guide preferably includes a cylindrical portion that surrounds the cavity, the cylindrical portion including a side wall and the force transfer surface. The force transfer surface is preferably at a first end of the guide. The guide preferably also includes a retainer that removably engages the cylindrical portion at a second end of the guide. The stop on the punch preferably engages the retainer when the guide is in the reset position. The retainer includes an opening through which the punch slides as the guide moves between the reset position and hammer position. A plurality of different types of punches can preferably be used with the hammer punch tool. The punches have different material forming ends for shaping material in a desired manner. The hammer punch tool also preferably includes a handle that is pivotably coupled to the guide. The invention also encompasses a kit including the guide and punch described above in a disassembled manner.

A method of forming material with the hammer punch tool described above includes steps of positioning the first end of the punch on a portion of material to be formed; sliding the guide in a first direction relative to the punch to place the punch in an extended position (or reset position of the guide), in which the stop engages the guide; and sliding the guide in a second direction, opposite to the first direction, relative to the punch to place the punch in a retracted position and impact the second end of the punch with the force transfer surface of the guide. The user preferably grasps the portion of the punch positioned outside of the cavity of the guide with one hand and the handle of the tool with the other hand. Because the punch is slidably coupled to the guide, the user can quickly and easily slide the punch from the hammer position to the reset position and back to the hammer position in a controlled manner without lifting the punch from the material being formed. The user can also easily vary the amount and direction of force and energy transferred to the punch and material being formed. Further, while the guide is in the reset position, the user may move the punch to a different location on the material being shaped and/or vary the angle between the punch and the material being shaped.

The hammer punch tool allows a user to continuously move the punch on the material being formed and hit the punch with the guide at desired times and with a desired amount of force without lifting the punch from the material. The structure of the hammer punch tool gives the user control over the amount of force and energy transferred from the guide to the punch and the direction in which that force is directed.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
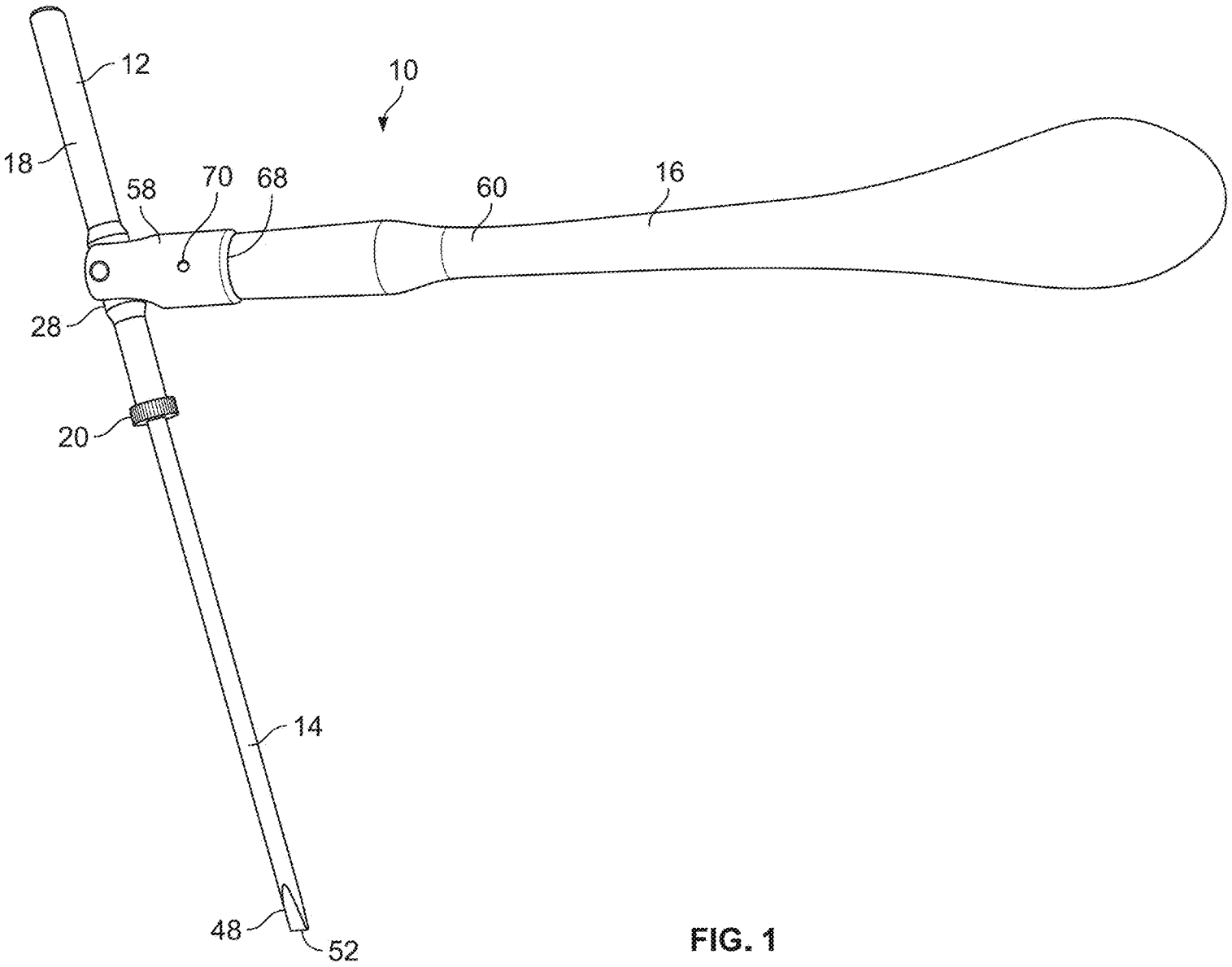
FIG. 1 is a perspective view of a hammer punch tool in accordance with one embodiment of the invention described herein showing a punch in an extended position.

A hammer punch tool in accordance with one embodiment of the invention described herein is identified generally as 10 in FIG. 1. Hammer punch tool 10 is designed for shaping material such as jewelry. For example, hammer punch tool 10 may be used to bezel-mount a stone for jewelry.

Figure 5:
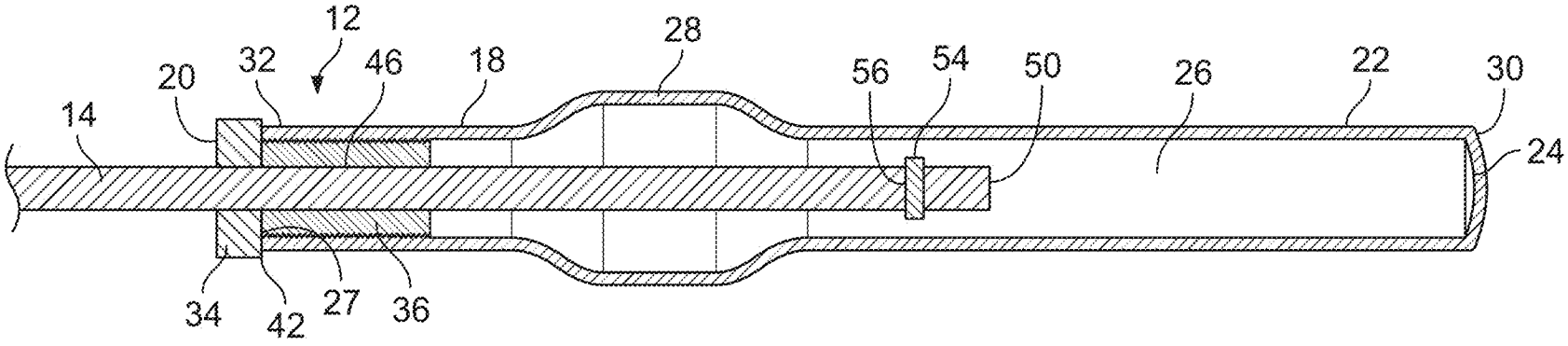
FIG. 5 is a cross-sectional view of the hammer punch tool taken through the line 5-5 in FIG. 3.

Hammer punch tool 10 includes a guide 12, a punch 14, and a handle 16. Guide 12 has a cylindrical portion 18 and a retainer 20 that is removably coupled to cylindrical portion 18. Referring to FIG. 5, cylindrical portion 18 has a side wall 22 and an end wall, or force transfer surface, 24 that surround a generally elongate cavity 26. Cavity 26 is accessible through an opening 27 in guide 12. Side wall 22 has an enlarged diameter portion 28 where handle 16 pivotably couples to guide 12, as described in more detail below. Guide 12 has a first end 30 that includes force transfer surface 24 and a second end 32 where retainer 20 is coupled to cylindrical portion 18. Force transfer surface 24 extends across an end of the cavity 26. It is also within the scope of the invention for force transfer surface 24 to be positioned within cavity 26 between first end 30 and second end 32 and extend across all or a portion of cavity 26 in a manner that allows force transfer surface 24 to engage and strike the second end 50 of punch 14, as described in more detail below.

Figure 4:
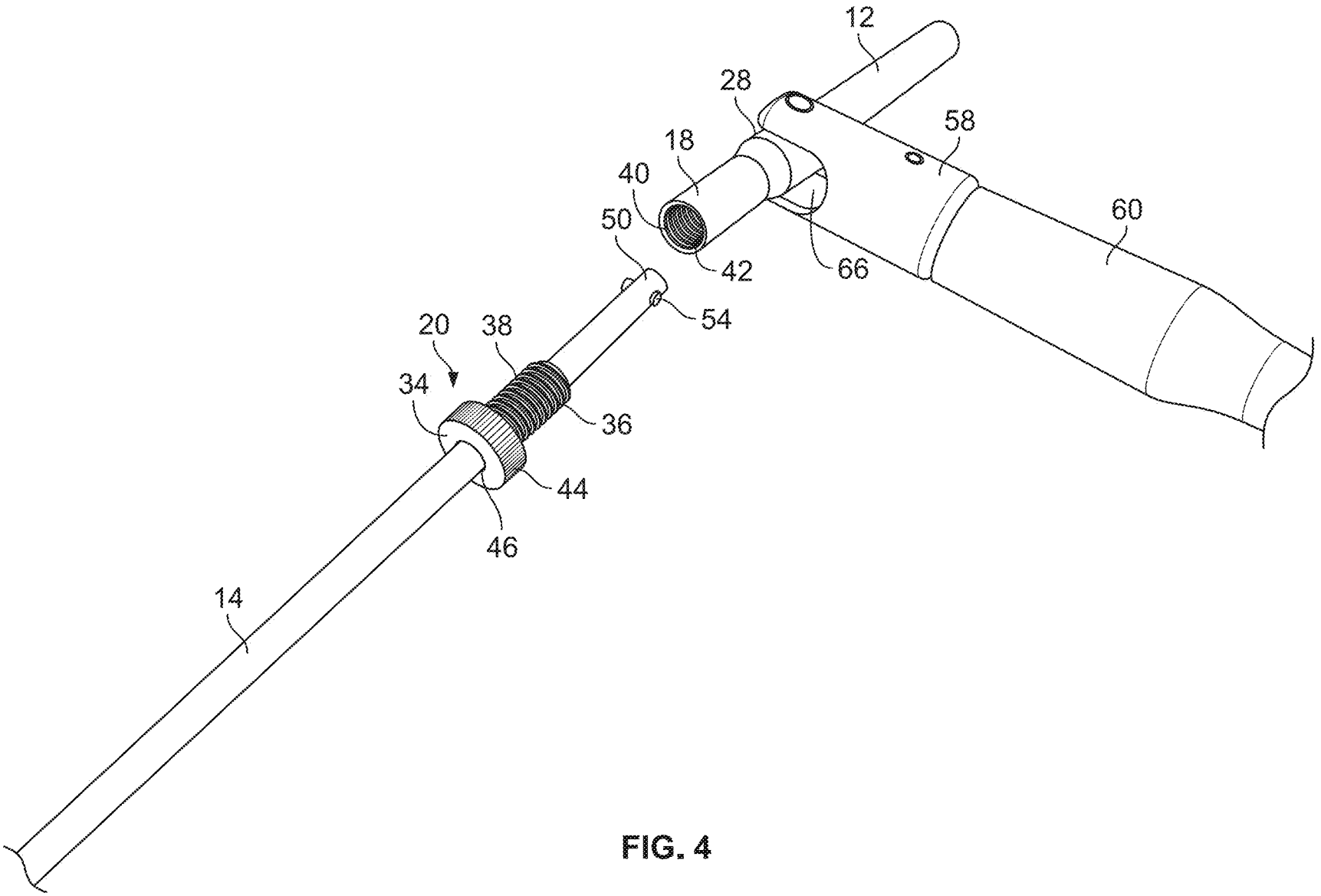
FIG. 4 is a partially exploded perspective view of the hammer punch tool of FIG. 1.

As shown in FIG. 4, retainer 20 has a head 34 and a shaft 36 that is coupled to and extends from the head 34. Shaft 36 has external threads 38 that engage internal threads 40 of cylindrical portion 18. Head 34 abuts an end 42 of cylindrical portion 18 when retainer 20 is coupled to cylindrical portion 18, as shown in FIG. 5. Head 34 has a knurled outer surface 44 to facilitate a user's ability to grip retainer 20 and thread it within cylindrical portion 18. An opening 46 extends through the retainer 20 and slidably receives a portion of punch 14, which portion of punch 14 also extends through opening 27 into cavity 26. Although retainer 20 is shown as being removably coupled with cylindrical portion 18, it is within the scope of the invention for retainer 20 to be permanently coupled with cylindrical portion 18 by, for example, welding.

Punch 14 is a generally elongate cylinder and includes a first end 48 (FIG. 1) and a second end 50 (FIG. 5). First end 48 is positioned outside of cavity 26 and second end 50 is positioned within cavity 26, such that a portion of punch 14 between first end 48 and second end 50 is slidably received within cavity 26 through opening 27. The first end 48 of punch 14 is tapered to a flat edge 52 that is formed to shape material, such as jewelry. Punch 14 includes a stop 54 (FIGS. 4 and 5) that is positioned adjacent second end 50 within cavity 26. Stop 54 is a cylinder that is inserted through an opening 56 in punch 14. Stop 54 has a length that is slightly greater than the diameter of the remainder of punch 14 so that a portion of stop 54 extends laterally outward from each side of the remainder of punch 14. The portion of punch 14 between stop 54 and first end 48 has an external diameter that is slightly smaller than the diameter of the opening 46 in retainer 20, such that this portion of punch 14 is slidably received by and extends through the opening 46 in retainer 20. The length of stop 54 is greater than the diameter of the opening 46 in retainer 20 so that stop 54 and second end 50 of punch 14 cannot slide through the opening 46.

Figure 2:
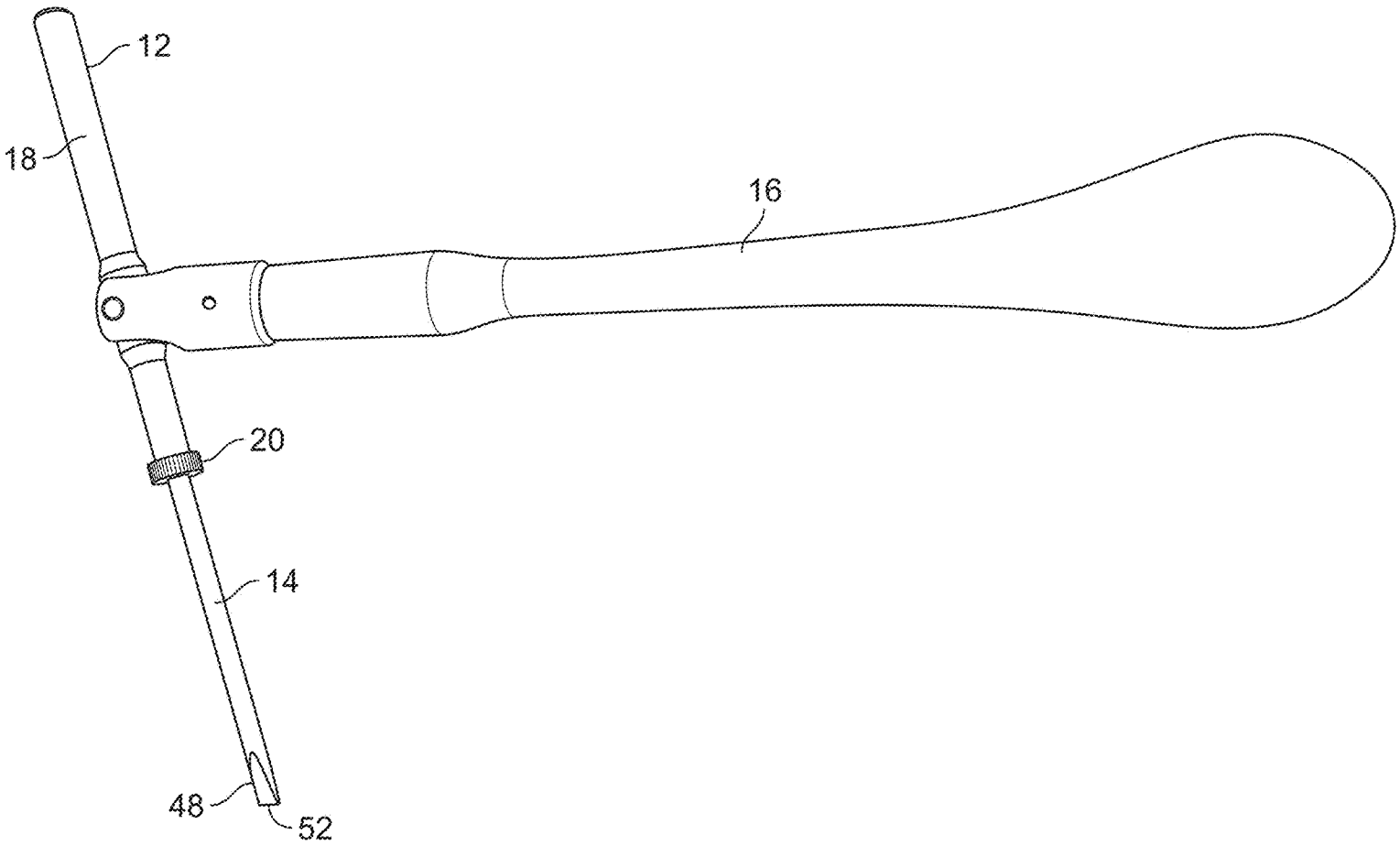
FIG. 2 is a perspective view of the hammer punch tool of FIG. 1 showing the punch in a retracted position.
Figure 7:
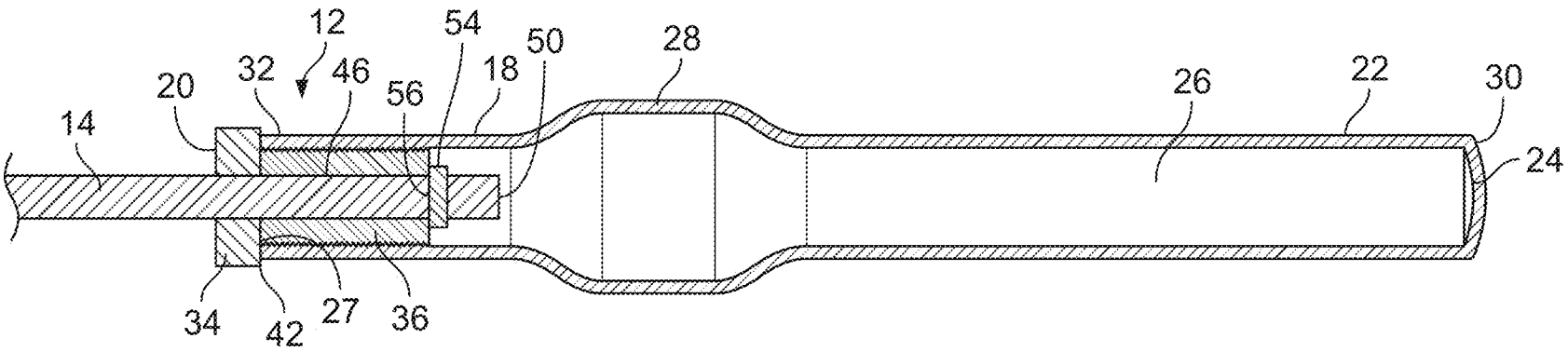
FIG. 7 is a cross-sectional view of the hammer punch tool similar to FIG. 5 and showing the punch in the extended position.
Figure 8:
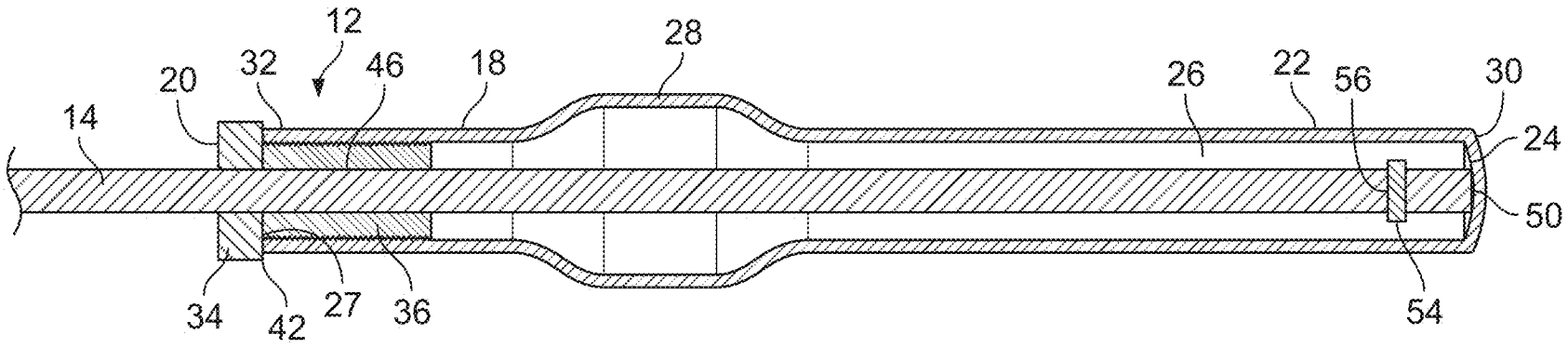
FIG. 8 is a cross-sectional view of the hammer punch tool similar to FIG. 5 and showing the punch in the retracted position.

Guide 12 slides relative to punch 14 between a reset position of the guide 12 (or extended position of punch 14), as shown in FIGS. 1 and 7, and a hammer position of the guide 12 (or retracted position of punch 14), as shown in FIGS. 2 and 8. When guide 12 is in the reset position shown in FIGS. 1 and 7, stop 54 (FIG. 5) engages the end of retainer 20 to retain the second end 50 of punch 14 within the cavity 26 of guide 12 and prevent the second end 50 of punch 14 from sliding out of the cavity 26 through the openings 27, 46. As guide 12 slides relative to punch 14 to the hammer position shown in FIGS. 2 and 8, the force transfer surface 24 (FIG. 5) engages the second end 50 of punch 14 within cavity 26 to transfer energy and force from guide 12 to punch 14 and a material being shaped that is in contact with the first end 48 of punch 14. Guide 12 and punch 14 are dimensioned so that a user may grasp with a hand the portion of punch 14 extending from its first end 48 to guide 12 when the guide 12 is in the hammer position shown in FIG. 2. This allows the user to precisely control the position of first end 48 on the material being shaped and the angle of punch 14 relative to the material being shaped.

Figure 3:
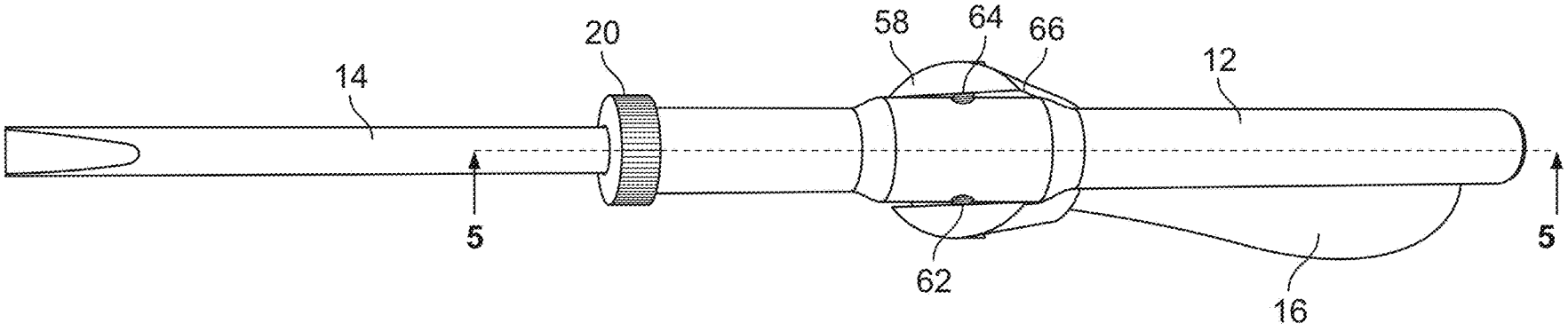
FIG. 3 is a top plan view of the hammer punch tool of FIG. 1.

Referring to FIG. 1, handle 16 includes a clevis 58, which is pivotably coupled to the enlarged diameter portion 28 of guide 12, and a shaft 60 that is coupled to clevis 58. Clevis 58 is pivotably coupled to guide 12 with a pair of pins 62, 64 (FIG. 3) each received by an opening in clevis 58 and an aligned opening in guide 12. Pins 62, 64 do not pass through the cavity 26 of guide 12 so that they do not interfere with punch 14 as it slides within guide 12. Clevis 58 includes a U-shaped groove 66 that receives the enlarged diameter portion 28 of guide 12, as shown in FIG. 4. The pivotal connection between handle 16 and guide 12 allows guide 12 to rotate relative to handle 16 within a range of approximately 90 degrees. For example, when guide 12 is approximately perpendicular to handle 16, guide 12 can rotate approximately 45 degrees in each direction before further rotation of guide 12 with respect to handle 16 is prevented by engagement between the guide 12 and the surface of clevis 58 forming U-shaped groove 66.

Shaft 60 includes an upper portion (not shown) that is received by an opening 68 (FIG. 1) in clevis 58. A pin 70 is inserted through aligned openings in clevis 58 and the upper portion of shaft 60 to securely fasten shaft 60 to clevis 58. Shaft 60 has a contoured outer surface so that a user can comfortably grasp the shaft 60. Shaft 60 is preferably wood while the remainder of hammer punch tool 10 (i.e., guide 12, punch 14, and clevis 58), is metal, such as steel. However, the components of hammer punch tool 10 may be formed from any suitable material.

Figure 6:
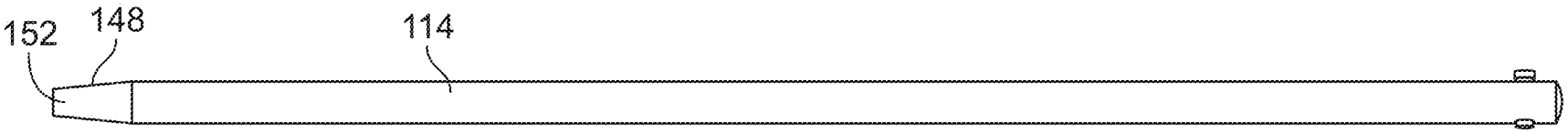
FIG. 6 is a top plan view of an alternative embodiment of punch for use with the hammer punch tool of FIG. 1.

FIG. 6 shows an alternative punch 114 that can be used with hammer punch tool 10 in lieu of punch 14. Punch 114 is substantially similar to punch 14. Thus, only the differences between the two punches 14, 114 are described in detail herein. The first end 148 of punch 114 that is positioned outside of cavity 26 during use is tapered to a blunt point 152. In this manner, punch 114 can shape material in a different manner than punch 14. Additional punches that are substantially similar to punch 14 but with ends formed to shape material in a different manner than punch 14 can also be used with hammer punch tool 10. Alternatively, it is also anticipated that the first end 48, 148 of either of punches 14, 114 can be configured to removably secure different shaped tool heads. For example, first end 48, 148 may be tubular in nature with internal threading for removably securing to the first end 48, 148 various tool heads each having an externally threaded neck.

In use, a user first assembles hammer punch tool 10 with the desired punch, which can be punch 14, punch 100, or another punch having an end shaped in a different manner than punches 14, 100. Assuming that the user desires to use punch 14, hammer punch tool 10 is assembled substantially as shown in FIG. 4. Punch 14 is removably connected to guide 12 by inserting punch 14 through the opening 46 in retainer 20 so that shaft 36 of retainer 20 faces the second end 50 of punch 14. The second end 50 of punch 14 is then inserted into the cavity 26 of guide 12 and the external threads 38 of shaft 36 are threaded into engagement with the internal threads 40 of guide 12. Retainer 20 is rotated until shaft 36 is entirely positioned within the cavity 26 of guide 12.

With punch 14 slidably coupled to guide 12, the user then grasps handle 16 with one hand and a portion of punch 14 adjacent first end 48 with the other hand. The first end 48 of punch 14 is positioned on a material to be formed or shaped. For example, the first end 48 may be positioned on jewelry for bezel-mounting a stone. The user then moves handle 16 to slide guide 12 in a first direction away from the first end 48 of punch 14 placing guide 12 in the reset position shown in FIGS. 1 and 7. Next, the user slides guide 12 in a second direction, opposite to the first direction, toward the first end 48 of punch 14 to strike punch 14 with guide 12 and place guide 12 in the hammer position shown in FIGS. 2 and 8. As the guide 12 slides relative to punch, the force transfer surface 24 of guide 12 engages and impacts the second end 50 of punch to transfer energy and force from guide 12 to punch 14 and from punch 14 to the material being formed or shaped. The user may repeat the steps of sliding guide 12 from the hammer position to the reset position and back to the hammer position (striking punch 14 with guide 12 in the process) until the material is shaped in the desired manner.

Because the punch 14 is slidably coupled to the guide 12, the user can quickly and easily repeat this motion in a controlled manner without lifting the punch 14 from the material being formed. The user can also easily vary the amount and direction of force and energy transferred to the punch 14 and material being formed by striking the punch 14 with varying amounts of force and/or tilting the hammer punch tool 10 with respect to the material. Further, while the guide 12 is in the reset position and/or while the user slides guide 12 in a continuous manner back and forth with respect to punch 14, the user may move the first end 48 of punch 14 to a different location on the material being shaped and/or vary the angle between the first end 48 of punch 14 and the material being shaped. The rotatable connection between guide 12 and handle 16 allows the user to quickly move the first end 48 of punch 14 and vary the angle between punch 14 and the material being shaped. The user may continuously move the punch 14 with respect to the material being shaped without lifting the punch 14 from the material and while repeatedly striking the punch 14 with the force transfer surface 24 of guide 12.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hammer punch tool configured for shaping jewelry, comprising:

a guide comprising a force transfer surface and a cavity accessible through an opening in the guide;

a punch having a portion slidably received within the cavity of the guide through the opening in the guide, wherein the punch comprises a stop that is positioned within the cavity, wherein the punch is moveable between an extended position and a retracted position relative to the guide, wherein the stop engages the guide when the punch is in the extended position, wherein the force transfer surface engages the punch when the punch is in the retracted position to transfer force and energy to jewelry being shaped, and wherein the guide and punch are configured to allow a user to slide the guide in a continuous manner back and forth with respect to the punch between the extended position and the retracted position and strike the punch with the force transfer surface to transfer force and energy to the jewelry being shaped each time the punch reaches the retracted position relative to the guide; and a handle that is pivotably coupled to the guide, wherein the pivotal coupling between the handle and the guide is configured to allow a user to shape the jewelry by moving the punch with respect to the jewelry being shaped and altering the angle between the punch and the jewelry being shaped while moving the handle to slide the guide in a continuous manner back and forth with respect to the punch.

2. The hammer punch tool of claim 1, wherein the guide comprises a first end and a second end, wherein the force transfer surface is adjacent the first end of the guide and the opening is formed in the second end of the guide.

3. The hammer punch tool of claim 2, wherein the guide comprises a cylindrical portion comprising the force transfer surface, wherein the cylindrical portion surrounds the cavity, and wherein the guide comprises a retainer that is coupled with the cylindrical portion.

4. The hammer punch tool of claim 3, wherein the retainer presents the opening in the guide, and wherein the stop engages the retainer when the punch is in the extended position.

5. The hammer punch tool of claim 4, wherein the retainer comprises a head and a shaft that is coupled to and extends from the head, wherein the shaft comprises external threads that engage internal threads of the cylindrical portion, and wherein the head abuts an end of the cylindrical portion.

6. The hammer punch tool of claim 3, wherein the retainer is removably coupled with the cylindrical portion.

7. The hammer punch tool of claim 1, wherein the punch comprises a first end that is positioned outside of the cavity and a second end that is positioned within the cavity, wherein the first end of the punch is formed to shape material and wherein the stop is positioned adjacent the second end of the punch.

8. The hammer punch tool of claim 7, wherein a length of the punch extending from the first end to the guide is operable to be grasped by a user when the punch is in the retracted position.

9. A hammer punch tool configured for shaping jewelry, comprising:

a guide comprising a side wall that defines a cavity, a first end comprising a force transfer surface, and a second end presenting an opening;

a punch comprising a first end that is positioned outside of the cavity and a second end that is positioned within the cavity, wherein a portion of the punch extends through the opening in the guide, wherein the guide slides relative to the punch between a reset position, in which a portion of the punch engages the guide to retain the second end of the punch within the cavity, and a hammer position, in which the force transfer surface engages the second end of the punch to transfer force and energy to jewelry being shaped, and wherein the guide and punch are configured to allow a user to slide the guide in a continuous manner back and forth with respect to the punch between the reset position and the hammer position and strike the punch with the force transfer surface to transfer force and energy to the jewelry being shaped each time the guide reaches the hammer position relative to the punch; and a handle that is pivotably coupled to the guide, wherein the pivotal coupling between the handle and the guide is configured to allow a user to shape the jewelry by moving the first end of the punch with respect to the jewelry being shaped and altering the angle between the first end of the punch and the jewelry being shaped while moving the handle to slide the guide in a continuous manner back and forth with respect to the punch.

10. The hammer punch tool of claim 9, wherein the guide comprises a cylindrical portion that comprises the side wall and the force transfer surface.

11. The hammer punch tool of claim 10, wherein the guide comprises a retainer that is coupled with the cylindrical portion at the second end of the guide, wherein the retainer presents the opening in the guide, and wherein the punch engages the retainer when the guide is in the reset position.

12. The hammer punch tool of claim 11, wherein the retainer is removably coupled with the guide.

13. The hammer punch tool of claim 9, wherein the punch comprises a stop adjacent the second end of the punch, and wherein the stop engages the guide when the guide is in the reset position.

14. A method of shaping jewelry with a hammer punch tool comprising a guide, a handle that is pivotably coupled to the guide, and a punch that is at least partially positioned within a cavity of the guide, wherein the guide comprises a force transfer surface, and wherein the guide presents an opening, wherein a portion of the punch extends through the opening in the guide into the cavity, wherein the punch comprises a stop that is positioned within the cavity, wherein the punch comprises a first end positioned outside of the cavity, and wherein the punch comprises a second end positioned within the cavity, the method comprising:

grasping a portion of the punch positioned outside of the cavity with one hand;

grasping the handle with another hand;

positioning the first end of the punch on a portion of jewelry shaped;

moving the handle to slide the guide in a first direction relative to the punch to place the punch in an extended position, in which the stop engages the guide;

moving the handle to slide the guide in a second direction, opposite to the first direction, relative to the punch to place the punch in a retracted position and impact the second end of the punch with the force transfer surface of the guide to transfer force and energy to the jewelry being shaped;

moving the handle to slide the guide in a continuous manner back and forth with respect to the punch between the extended position and the retracted position and striking the punch with the force transfer surface to transfer force and energy to the jewelry being shaped each time the punch reaches the retracted position relative to the guide; and while moving the handle to slide the guide in a continuous manner back and forth with respect to the punch, moving the first end of the punch with respect to the jewelry being shaped and altering the angle between the first end of the punch and the jewelry being shaped via the handle pivoting with respect to the guide.

15. A hammer punch tool configured for shaping jewelry, comprising:

a guide comprising an elongate cavity accessible through an opening in the guide, wherein the guide comprises a force transfer surface extending at least partially across the cavity, wherein the force transfer surface is positioned within the cavity or at an end of the cavity;

an elongate punch at least a portion of which is configured to be slidably received through the opening into the cavity, wherein the punch comprises a first end that is configured to shape jewelry and a second end that is configured to engage the force transfer surface within the cavity to transfer force and energy to the jewelry being shaped, wherein the punch comprises a stop that is configured to prevent the second end of the punch from sliding out of the cavity through the opening, and wherein the guide and punch are configured to allow a user to slide the guide in a continuous manner back and forth with respect to the punch between an extended position, in which the stop engages the guide, and a retracted position, in which the force transfer surface engages the second end of the punch, and strike the punch with the force transfer surface to transfer force and energy to the jewelry being shaped each time the punch reaches the retracted position relative to the guide; and a handle that is pivotably coupled to the guide, wherein the pivotal coupling between the handle and the guide is configured to allow a user to shape the jewelry by moving the first end of the punch with respect to the jewelry being shaped and altering the angle between the first end of the punch and the jewelry being shaped while moving the handle to slide the guide in a continuous manner back and forth with respect to the punch.

16. The hammer punch tool of claim 15, wherein the guide further comprises a removable retainer that is configured to engage the stop to prevent the second end of the punch from sliding out of the cavity through the opening.

17. The hammer punch tool of claim 16, wherein the retainer removably connects the punch to the guide.

* * * * *